United States Patent [19]

Ulmann

[11] 3,967,411

[45] July 6, 1976

[54] PASSAGES FOR ONE-WAY TRAVERSAL ESPECIALLY FOR PASSENGER TRAFFIC IN STATIONS

[75] Inventor: Charles Ulmann, Paris, France

[73] Assignee: Etablissements Georges Klein, Paris, France

[22] Filed: June 14, 1974

[21] Appl. No.: 479,523

[30] Foreign Application Priority Data

June 19, 1973 France ..... 73.22246

[52] U.S. Cl. ..... 49/68

[51] Int. Cl.[2] ..... E06B 7/00

[58] Field of Search ..... 49/35, 44, 45, 49, 68, 49/115, 46

[56] References Cited

UNITED STATES PATENTS

| | | | |
|---|---|---|---|
| 220,624 | 10/1879 | Jörgensen | 49/49 |
| 349,156 | 9/1886 | Greenleaf | 49/46 |
| 677,294 | 6/1901 | Van Kannel | 49/68 |
| 2,258,896 | 10/1941 | Kelker | 49/49 X |
| 3,169,329 | 2/1965 | Powers | 49/35 |
| 3,314,198 | 4/1967 | Frisk | 49/68 X |
| 3,386,202 | 6/1968 | Crews et al. | 49/35 |
| 3,478,467 | 11/1969 | May | 49/35 |

FOREIGN PATENTS OR APPLICATIONS

| | | | |
|---|---|---|---|
| 556,337 | 7/1923 | France | 49/46 |

*Primary Examiner*—Paul R. Gilliam
*Assistant Examiner*—Carl F. Pietruszka
*Attorney, Agent, or Firm*—Larson, Taylor & Hinds

[57] ABSTRACT

The passage comprises two successive gates, maneouvrable in rotation in a single direction and conjugated to one another so that initially one is closed and the other open. These gates are sufficiently close to one another so that, on the opening of the first by a passenger arriving in the normal direction, the other closes thereby resisting the passage of a defrauder in the opposite direction.

9 Claims, 9 Drawing Figures

PASSAGES FOR ONE-WAY TRAVERSAL ESPECIALLY FOR PASSENGER TRAFFIC IN STATIONS

The invention relates to passages for one-way traversal, in particular of the type used in stations of transportation systems, these passages being either manually operable, that is to say caused to work by a maneouvre of the passenger, or automatic in operation, that is to say in continuous motion. It is understood that these passages can be of the free type, especially when they relate to exit passages, or of the pay type, if they are entry passages.

In such passages, fraud on the part of passengers seeking to enter in the prohibited direction has to be avoided, particularly where exit passages are concerned, which being traversed by fraudulent persons in the reverse direction to the permitted direction, would enable the latter to enter without paying.

Passages of this type have already been known for a long time, especially for exits, with two gates or two barriers connected to one another by engagement means such that the second gate, in the normal exit direction, is blocked as long as the passenger has not passed the first. But it was noted that the engagement means were fairly easily put out of action by defrauders.

These passages have now been given up and reliance is often placed for the exit, on providing only gates opening in one direction and pushed by the passenger going in the normal direction. However it has been noted that there is a possibility for a defrauder to pass in the forbidden direction at the moment when the gate is opened by said passenger.

It is an object of the invention to overcome these drawbacks.

It consists, principally, in making the abovesaid passages comprise two successive gates, maneouvrable in rotation in a single direction, and conjugated to one another so that initially one is closed and the other opened, these gates being sufficiently close to one another so that, on the opening of the first by a passenger arriving in the normal direction, the other is closed thereby resisting the passage of a defrauder in the opposite direction.

It will generally be convenient to constitute each gate by two leaves adapted to rotate respectively, in opposite directions, around two axes facing each other and arranged substantially along opposite surfaces of the passage. The latter is then bounded by boxes into each of which can be retracted, on rotation, one half leaf. In this way, the width of said boxes can be kept moderate, that is to say substantially one half of the width of the passage or a little more.

As regards the separation of the axes of the two gates in the direction of the length of the passage, it is advantageous to make them as close as possible, the trajectories of respective leaves of two gates being able to intersect.

It is to be noted in addition that the word gate must be taken as quite general and that the gates concerned could, in certain cases, be constituted by simple barriers.

The invention comprises, apart from these main features, of certain other features which are preferably used at the same time and which will be more explicitly considered below.

It relates more particularly to certain types of application (especially those for which it is applied to passages for passenger travel installations), as well as certain embodiments, of said features; and it relates, more particularly again and this by way of new industrial products, to passages of the type concerned including the application of these same features, as well as the special elements adapted for their construction and installations comprising such passages.

The invention will, in any case, be well understood by means of the additional description which follows, as well as of the accompanying drawings, which description and drawings are, of course, given particularly by way of indication, and not in any limiting sense.

Figure 8:
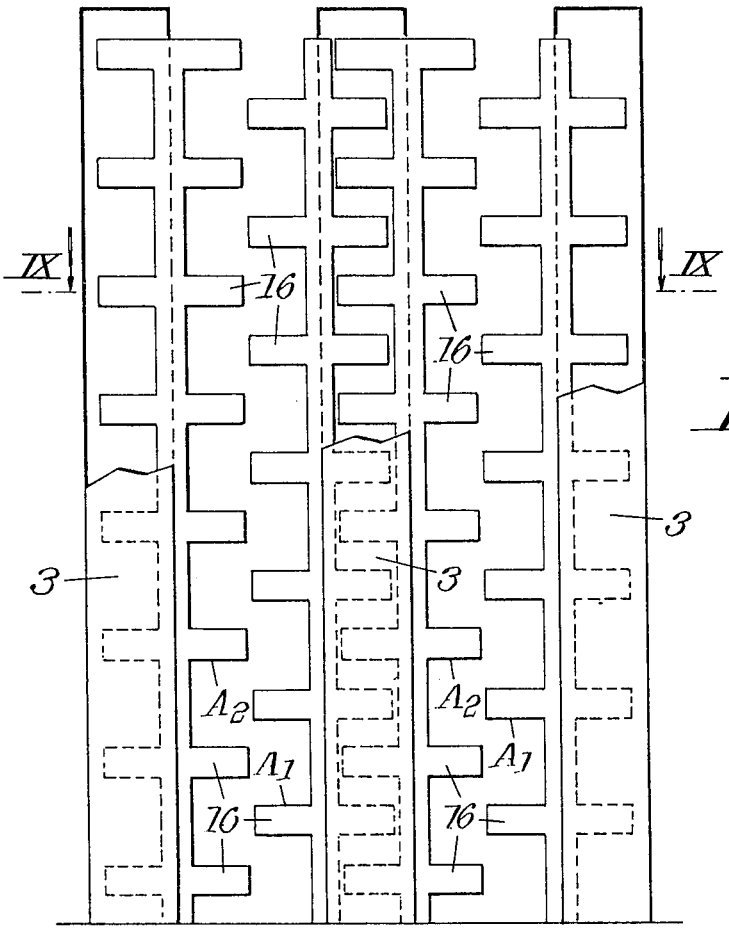
Figure 9:
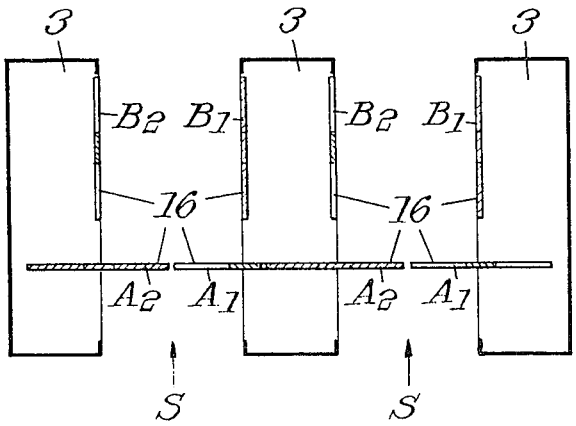

FIGS. 8 and 9, lastly, show respectively in lateral view and in plan view a one-way passage, constructed according to another embodiment of the invention.

According to the invention, and more particularly according to that of its types of application, as well as according to those embodiments of its various parts, to which it would appear that preference should be given, in order for example to construct a passage for a passenger transport installation, for example for the exit of the latter, procedure is as follows or in analogous manner.

Figure 1:
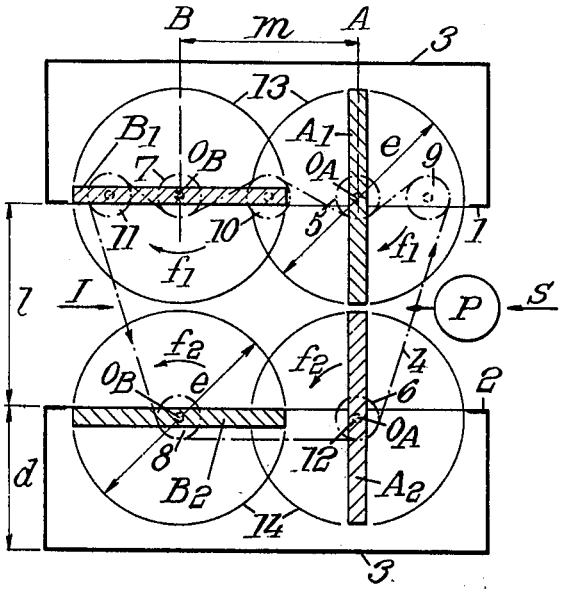
FIG. 1 shows diagrammatically in plan view a passage of the type for traversal in a single direction, this passage being constructed according to the invention and shown in the normal exit position.

This passage is made to comprise essentially, as shown in FIG. 1, where the arrow S indicates the normal direction of exit, two successive gates in two different relatively close planes A and B, these gates being drawn in a single direction and conjugated with one another, so that one is open when the other is closed.

Preferably, each of these gates is constructed by means of two leaves, as shown at $A_1$, $A_2$ and $B_1$, $B_2$.

The gate formed by leaves $A_1$, $A_2$ rotates around axes $O_A$ placed opposite one another in the walls 1 and 2 of the passage, whilst similarly the leaves $B_1$, $B_2$ rotate around axes $O_B$ arranged similarly in said walls.

The passage being assumed to have a width $l$, the width $e$ of the leaves will be selected substantially the same and there will be provided, in the surfaces 1 and 2, rectangular openings to provide for the changing positions of the leaves concerned.

These walls 1 and 2 belong to boxes 3 whose width $d$ will be provided a little greater than half width $e2$ of the leaves, again to enable the changes in position of the half leaves above-mentioned.

This being the case, means are provided to conjugate the rotations of the various leaves, noting that the leaves $A_1$ $B_1$ will have to rotate in the same direction $f_1$ and the panels $A_2$ $B_2$ in the opposite direction $f_2$.

Said means can be constructed in numerous different ways, for example by means of a chain 4 in engagement, on one hand, with gear wheels 5, 6, 7 and 8 mounted respectively on the four axles $\mathbf{0}_A$ $\mathbf{0}_B$, and on the other hand, with return wheels such as 9, 10, 11, the assembly being such that this chain ensures the rotations in the above-mentioned directions $f_1$ and $f_2$.

Finally, there is combined with the assembly anti-return means, that is to say means ensuring the movement of the chain in a predetermined direction without the possibility of turning back. These means can be arranged in any suitable way, for example consist of a free-wheel type device 12, mounted for example on one of the axles concerned.

The assembly of the mechanism could be housed, either above the passage, if this is possible, or preferably on the other hand at the base of the latter in an excavation provided in the ground.

As regards the distance *m* to be provided between the respective axles of the two gates thus arranged, it is advantageous to reduce it to the minimum, that is to say to arrange so that the circular paths 13, 13 and 14, 14 (FIG. 1), of the respective leaves belonging to the two gates, intersect, this in so far as however the freedom of rotation of the two leaves remains complete.

There is thus obtaned an assembly whose operation is as follows.

Assuming that the manipulation of the gates is manual, a traveller P arriving in the direction S pushes the leaves of the gate A, which causes the corresponding rotation of the two leaves of gate B. The four leaves are thus placed substantially in the form of a cross, which obviously resists the entry of a defrauder in the prohibited direction I.

Figure 3:
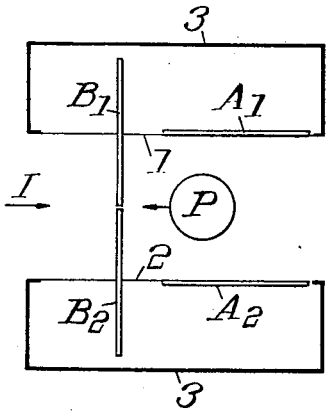
Figure 4:
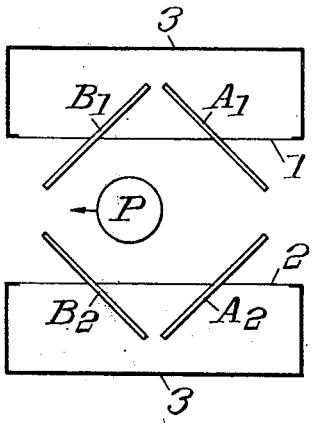

The traveller P continuing to advance and having consequently separated the two first leaves to their open position, finds himself before the leaves of gate B, which are then in closed position (FIG. 3).

Passing further, he separates these panels until he emerges finally by restoring the whole into the position of FIG. 1.

It is seen that the entry of another person, in the direction I is impossible.

It should be noted that, if necessary, there may be provided positioner means, which it is possible for the man skilled in the art to design, and which tend to restore the leaves to the open position parallel to the sides 1, 2 of the box, or into the normally closed position at these sides.

In the foregoing, it is assumed that the actuation of the gates or of the leaves was manual, but the invention covers the case of gates maneouvred by a motor, in continuous movement, the traveller presenting himself, in this case, at the moment when the gates occur in the initial position of FIG. 1, and being put into operation in the passage according to the speed of continuous rotation imparted by the mechanism to the abovesaid leaves.

From this solution, many others could be imagined.

It should be noted first of all that, in the case where leaves of solid form are used, their movement can be troublesome to a traveller carrying bags.

Figure 5:
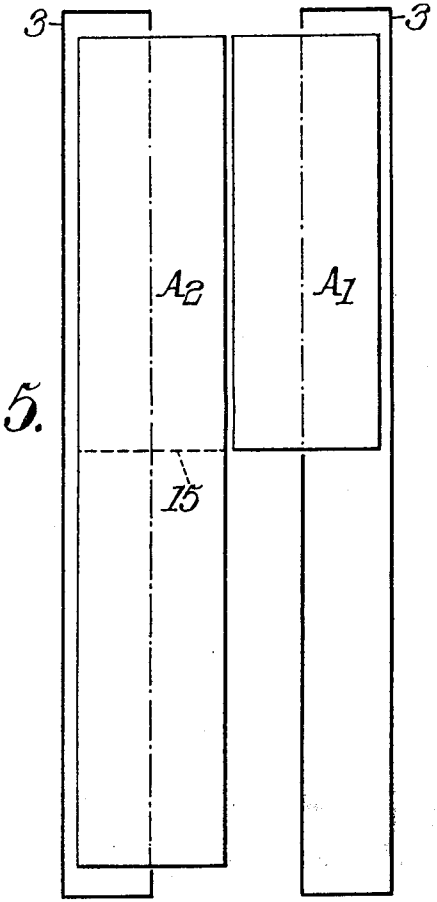
FIG. 5 illustrates diagrammatically in lateral view a passage of the same type, constructed according to a modification of the first embodiment.

This can be easily remedied by arranging that, as shown in FIG. 5, one of the leaves is eliminated at its lower portion, it being understood that the same could be done, if necessary, for the other leaf, as indicated in dashed-line, at 15, on this same Figure.

It will also be noted, of course, that the invention could be applied to several juxtaposed passages, to enable a larger amount of passenger traffic (the width *l* of each passage being relatively limited, of the order for example of 40 to 60 cm).

In the latter case, it is necessary to arrange that the leaves of the various gates do not mutually impede each other, the solutions to be proposed in this sense being a function of the nature of the actuation of the leaves.

Figure 6:
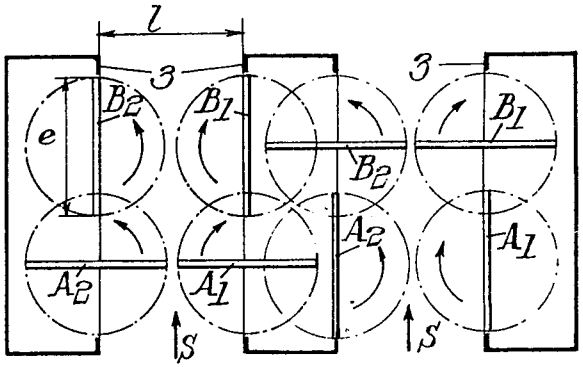
FIGS. 6 and 7 show respectively, each in plan view, two modifications of the above-mentioned passages according to the invention.

When the gates or leaves actuated in continuous manner from a mechanism are concerned, one can rely on juxtaposing the various gates in the following manner, in the different passages and at the same level. This is the solution shown in FIG. 6. In this case, the boxes 3 can retain a width a little greater then *e*/2. In fact, in this case, the various leaves are synchronized and consequently, cannot meet each other.

Figure 7:
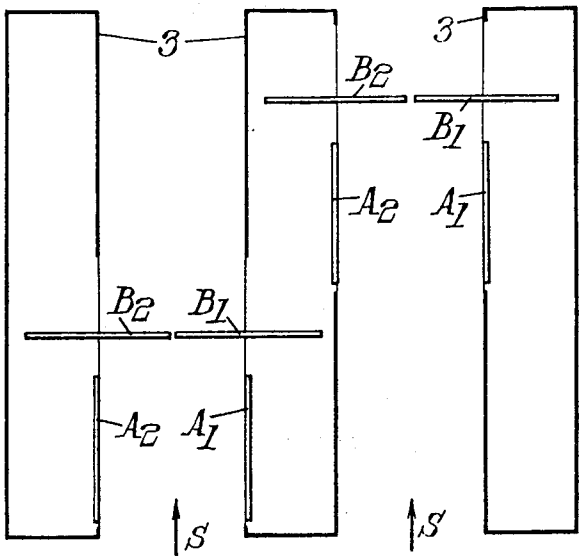

In the contrary case, where manual maneouvring is involved, it will be possible for example, as shown in FIG. 7, to stagger the gates of the various passages in the direction of the length of said passages.

Another solution consists of making the panels belonging to two juxtaposed passages interpenetrable.

This is the solution shown in FIGS. 8 and 9, where it is seen that the leaves are constituted here by types of comb-shaped structures, as seen in FIG. 8.

The teeth 16 of the leaves such as $A_1$ and $A_2$ belonging to two juxtaposed passages interpenetrate, being suitably staggered for this purpose.

Figure 2:
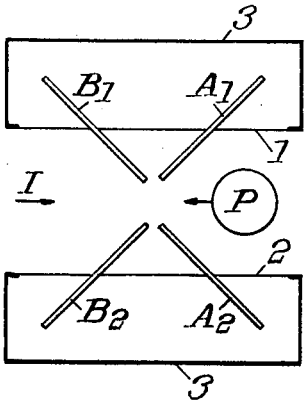
FIGS. 2, 3 and 4 show similarly and diagrammatically the same passage, in three successive positions on the passage of a traveller in the normal exit direction.

As a result of which, whatever the embodiment adopted, it is possible to produce installations in which it is impossible for a defrauder to start in the forbidden direction I, by attempting to open the gate. This passage is rendered impossible, this due to the fact that the rotation of the gates or leaves is irreversible, by reason of the cross-formation such as is seen in FIG. 2, and which obviously resists any passage in the direction I.

As is self-evident and as emerges already from the foregoing, the invention is in no way limited to those of its types of application and embodiments which have been more especially envisaged; it encompasses, on the contrary, all modifications.

What we claim is:

1. In a passage for traversal in one direction, means defining the passage, two successive gates for controlling traversal of said passage, each gate comprising at least one gate leaf, means mounting each gate leaf for rotation in a single direction only such that each gate successively opens and closes said passage during rotation, said rotational movement in a single direction of each gate leaf being such that the portion of the gate leaf in the passage at any time moves arcuately generally in said one direction only, and movement in the opposite is prevented by antireturn means, each gate being mounted such that a traversal path of said passage lies only on one side of the rotational axis of each gate leaf, means conjugating said gates to one another such that initially one is closed and the other open and such that on the opening of either one the other is closed, said successive gates being sufficiently closely spaced to one another as to resist the traversal of said passage by a person in other than said one direction upon opening of the first gate for traversal by a person in said one direction, and hence the simultaneous closing of the other gate, said passage being defined by barrier walls forming sides and entry and exit ends of the passage, and each gate leaf being pivotally mounted along a side of said passage such that during a complete rotation the gate leaf portion on one side of the pivot axis moves successively into said passage and into its side barrier wall, the pivot axes of successive gates being closely spaced such that their rotational trajectories intersect and overlap in said passage.

2. Passage according to claim 1, wherein the successive gates rotate in the same direction.

3. Passage according to claim 1, wherein each gate comprises two leaves, and means mounting the leaves of each gate to rotate respectively in opposite directions around two axes facing each other and arranged substantially along the opposite surfaces of the passage.

4. Passage according to claim 3, wherein corresponding leaves of the two gates rotate in the same direction.

5. Passage according to claim 3, wherein said passage has lateral sides formed by boxes into each of which are retractable, on rotation, one half leaf.

6. Passage according to claim 1, wherein the gates are of manual operation.

7. Passage according to claim 1, wherein the gates are motor driven.

8. Passage according to claim 1, wherein the conjugated rotation of the gates is effected by a chain driven system passing over gear wheels connected to the gates, in combination with a non-reversing device.

9. Passage as claimed in claim 1, further comprising return means for returning the gates, after the passage of a passenger, to a predetermined position.

* * * * *